United States Patent [19]

von Winckelmann

[11] 4,069,951

[45] Jan. 24, 1978

[54] CLOSURE ASSEMBLY FOR COLLAPSIBLE TUBE DISPENSERS, AND THE LIKE

[76] Inventor: Emil H. von Winckelmann, 7731 Amestoy Ave., Van Nuys, Calif. 91406

[21] Appl. No.: 698,010

[22] Filed: June 21, 1976

[51] Int. Cl.[2] ..... B65D 35/40

[52] U.S. Cl. ..... 222/494

[58] Field of Search ..... 239/533.13, 533.15; 137/843; 222/494

[56] References Cited

U.S. PATENT DOCUMENTS

| | | | |
|---|---|---|---|
| 1,922,652 | 8/1933 | Andersen | 222/494 |
| 2,605,026 | 7/1952 | Wagner | 222/494 UX |
| 3,831,629 | 8/1974 | Mackal | 137/843 |
| 3,913,809 | 10/1975 | Nilson | 222/494 |

*Primary Examiner*—Robert B. Reeves
*Assistant Examiner*—Norman L. Stack, Jr.
*Attorney, Agent, or Firm*—Keith D. Beecher

[57] ABSTRACT

A closure assembly is provided which is mounted on the end of a collapsible tube or pouch dispenser through which liquid, or soft solid substances such as toothpaste, shaving cream, catsup, mustard, shampoo, glue or the like, may be dispensed. The closure assembly allows the particular substance to be dispensed only when the tube is squeezed, and it automatically closes to prevent further flow of the substance when the squeezing pressure is removed. The closure member includes a flexible sleeve which is closed at one end and which is inserted into the neck of the dispenser. The sleeve normally expands against the inner peripheral surface of the neck to close and seal the opening to the tube or pouch. However, when a squeezing pressure is applied to the collapsible tube or pouch, the substance in the tube or pouch is forced out through the space between the inner peripheral surface of the neck and the outer peripheral surface of the resilient sleeve, to be dispensed so long as squeezing pressure is applied. However, the moment the squeezing pressure is removed, the resilient sleeve expands outwardly to close and seal the space between its outer peripheral surface and the inner surface of the mouth to prevent further flow of the substance therethrough.

8 Claims, 8 Drawing Figures

CLOSURE ASSEMBLY FOR COLLAPSIBLE TUBE DISPENSERS, AND THE LIKE

RELATED COPENDING APPLICATION

Application Ser. No. 579,786, Emil H. von Winckelmann filed May 22, 1975 for "Closure Assembly for Collapsible Tube Dispensers, and the Like".

BACKGROUND OF THE INVENTION

Closure assemblies for use with collapsible tube dispensers are known to the art, and these assemblies serve to control the discharge of liquids and soft solids from the collapsible dispensers. Such closure assemblies are intended to close automatically and to cut off the flow of the substance from the collapsible dispenser when the squeezing pressure has been removed. However, the prior art closure assemblies of this general type are usually bulky and cumbersome, have a tendency to be forced off the tip of the collapsible tube. Moreover, the prior art assemblies, for the most part, do not adequately function as an airtight, complete and sanitary seal to prevent further discharge of the substance within the dispenser when the squeezing pressure has been removed.

The closure assembly of the present invention is eminently simple in its construction, and it serves as a complete airtight and sanitary seal for the substance in the collapsible dispenser whenever the squeezing pressure is removed. The closure assembly of the invention is strong, durable and efficient in its operation, and it has no tendency to be forced out of the neck of the collapsible dispenser when the squeezing pressure is applied. Most importantly, the closure assembly of the invention, as will be described, is simple and inexpensive in its construction, and is easy to use.

DETAILED DESCRIPTION OF THE ILLUSTRATED EMBODIMENTS

Figure 1:
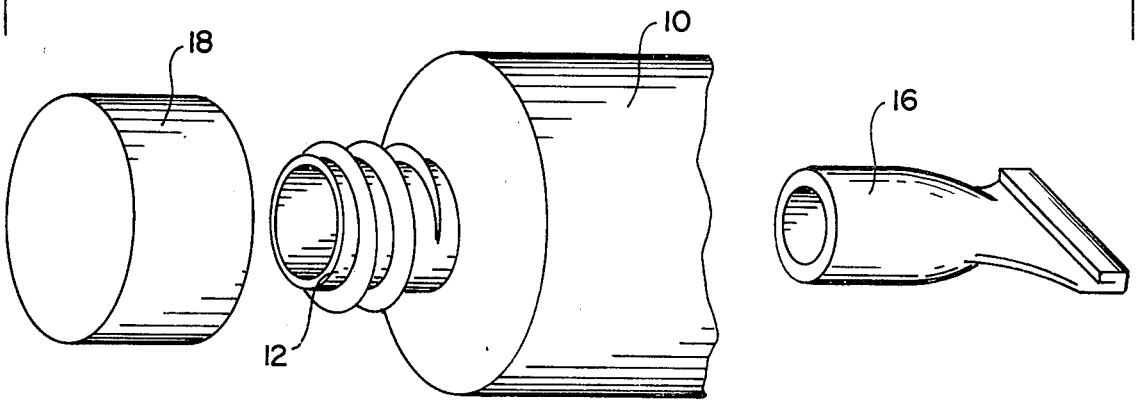
FIG. 1 is an exploded perspective representation showing one embodiment of the closure assembly of the invention in which a resilient sleeve is inserted into the neck of a collapsible tube dispenser.
Figure 2:
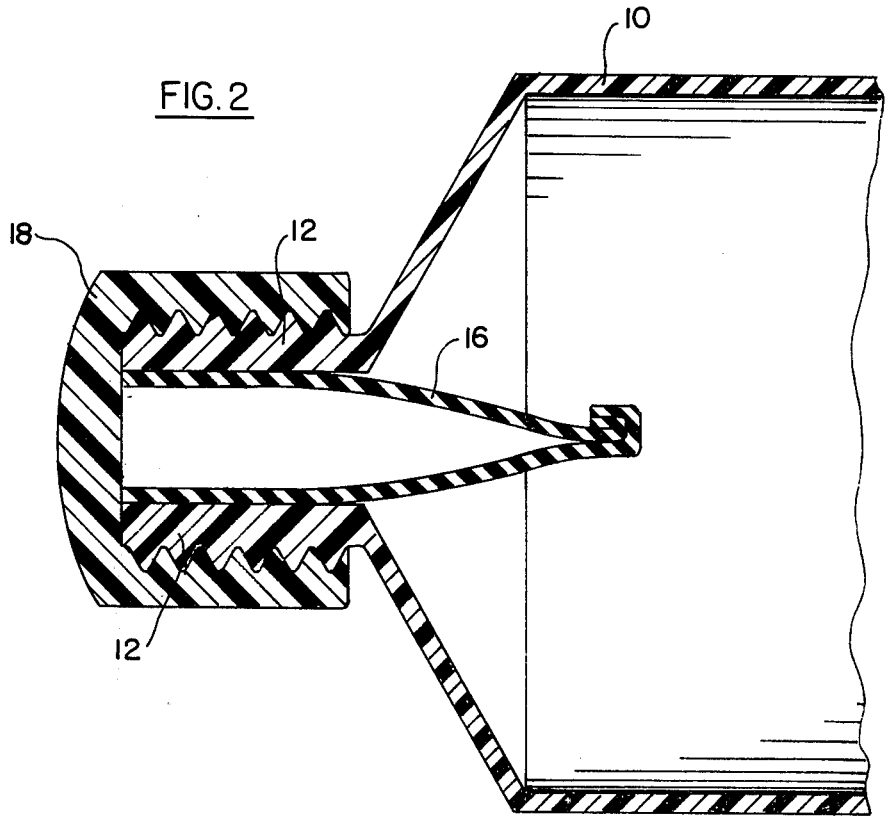
FIG. 2 is a side section of the assembly of FIG. 1.

In the embodiment of FIGS. 1 and 2, a collapsible tube or pouch dispenser 10 is provided with a hollow tubular neck 12. The neck 12 is threaded, as shown. The neck may be formed of any appropriate rigid plastic, or other suitable rigid material.

A sleeve 16, formed of rubber, or other appropriate resilient material, is inserted into the neck 12. The sleeve 16 is closed at one end, as shown, by clipping, gluing, or otherwise closing that end. Until a squeezing pressure is applied to the collapsible dispenser 10, the sleeve 16 expands and completely closes and seals the interior of the neck 12, so that the substance in the tube is retained therein.

Specifically, when there is no squeezing pressure applied to the wall of the collapsible dispenser 10, the resilient sleeve 16 forms a complete airtight seal within the neck 12, protecting the fluid within the tube, and also preventing any fluid from passing through the tip. However, when a squeezing pressure is applied to the dispenser 10, the fluid is forced into the space between the outer peripheral surface of the sleeve 16 and the inner surface of the neck 12, and through the outer end of the tip.

Since force exerted by the substance in the collapsible dispenser 10 in the presence of a squeezing pressure is directed to a large extent in a radially inwardly direction insofar as the resilient sleeve 16 is concerned, there is little or no tendency to force the sleeve out through the end of the tip, and the sleeve can be made sufficiently resilient, so that it will retain itself within the tip, without the need for any extraneous anchoring means.

A cap 18 may be provided to cover the assembly when not in use, the cap 18, in the embodiment of FIG. 1 being threaded onto the neck 12. Under normal operations, however, the cap 18 is not required, since the closure assembly of the invention forms a complete seal for the contents of tube 10. However, the cap 18 proves useful when the tube is packed, for example, for traveling or shipping purposes.

Figure 3:
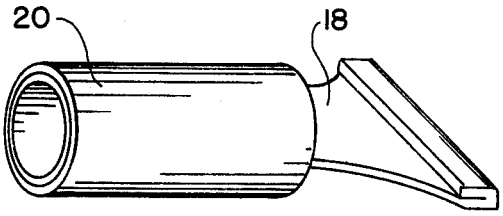
FIGS. 3 and 4 are further embodiments of the resilient sleeve.

In the embodiment of FIG. 3 the resilient sleeve 16 is supported in a rigid bushing 20, so that the closure assembly is a separate unit which may be slipped into the neck 12 of the collapsible tube.

Figure 4:
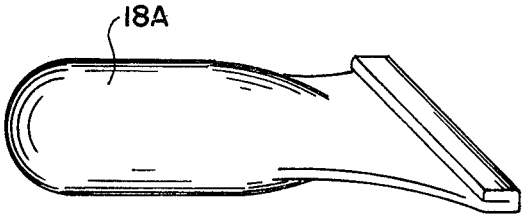

In the embodiment of FIG. 4, the collapsible sleeve is designated 18A, and the sleeve 18A is closed at its forward end to prevent accumulation within the interior of the sleeve.

Figure 6:
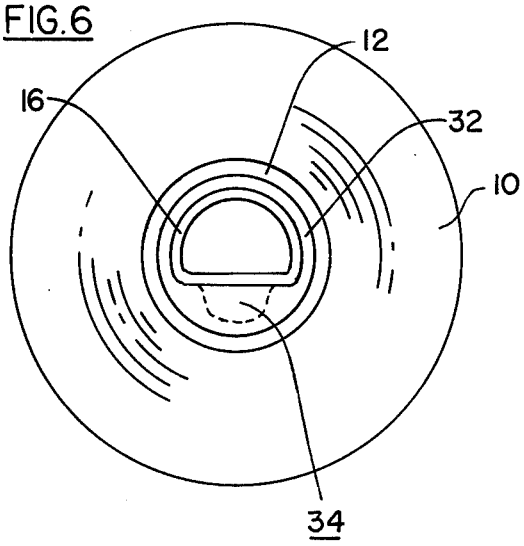
FIGS. 5, 6 and 7 are respective perspective, front and sectional views of a second embodiment.
Figure 5:
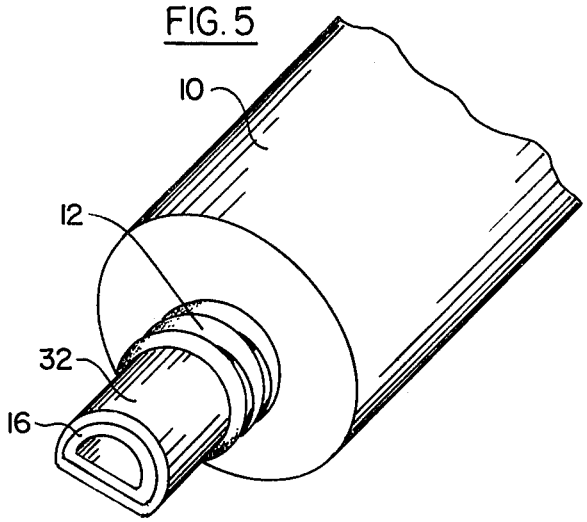
Figure 7:
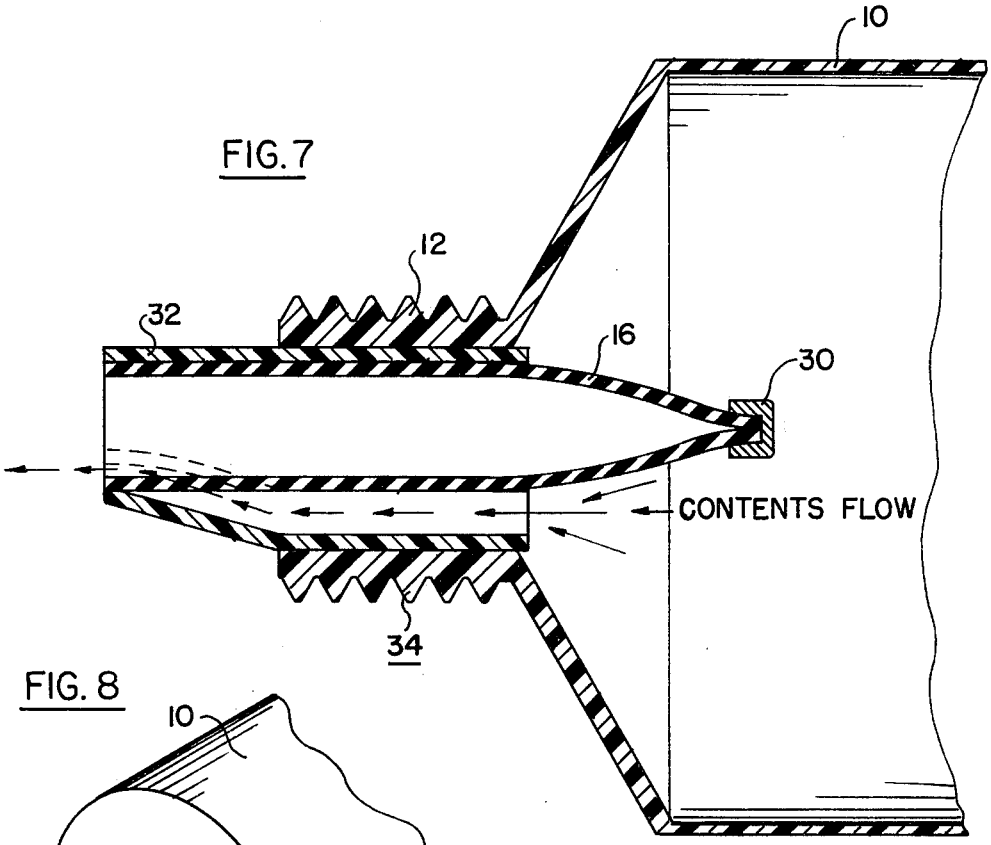

In the embodiment of FIGS. 5, 6 and 7, the righthand end of sleeve 16 is closed by a clip 30, and the sleeve is received in a rigid bushing 32. The bushing 32 has the illustrated configuration to define a channel 34, the channel providing that the contents of the tube will always flow out the same spot when the tube is squeezed. Although a separate bushing 32 is shown in the embodiment of FIGS. 5, 6 and 7, the neck itself of the collapsible tube 10 could be shaped to provide the channel 34, and the closure 16 could be inserted directly into the neck, as in the embodiments of FIGS. 1 and 2.

Figure 8:
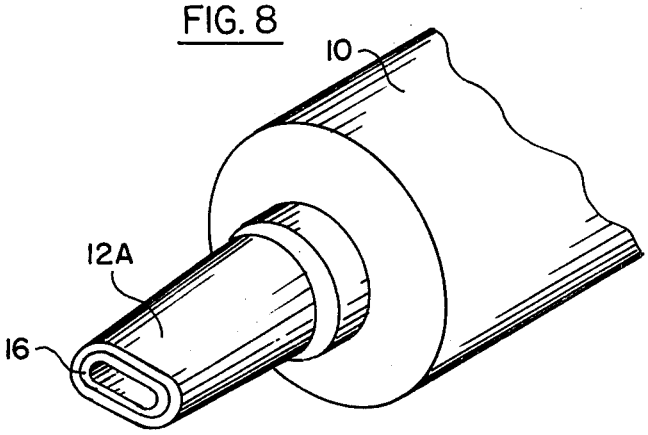
FIG. 8 is a perspective view of a third embodiment.

As shown in FIG. 8, the neck of collapsible tube 10 may, as designated 12A, have an oval, or other configuration, since it need not necessarily be circular in cross-section.

Accordingly, while particular embodiments of the invention have been shown and described, modifications may be made, and it is intended in the appended claims to cover all modifications which come within the true spirit and scope of the invention.

What is claimed is:

1. In combination a collapsible dispenser, and a closure assembly to control the discharge of fluids and soft solids from the dispenser, said dispenser having a neck with an elongated hollow tubular-shaped inner surface through which the fluids and soft solids are dispensed, and said closure assembly including: a resilient sleeve having an elongated tubular-shaped surface, and having a closed inner end of a width greater than the inner diameter of the neck, said sleeve being mounted coaxially within said neck with its external surface pressed against the inner surface of the neck in intimate contact therewith along the length of the neck to form an airtight seal therewith, said sleeve being retained within said neck solely by its engagement with said neck and without any external supporting means, whereby squeezing pressure applied to the dispenser causes the fluids and soft solids to be forced between the resilient sleeve member and the inner surface of the neck to displace the resilient sleeve radially inwardly so as to permit the fluids and soft solids to pass through the resulting space between the outer surface of the sleeve and the inner surface of the neck to be dispensed through the end of the neck.

2. In combination a collapsible dispenser, and a closed assembly to control the discharge of fluids and soft solids from the dispenser, said dispenser having a neck with an elongated hollow tubular-shaped inner surface through which the fluids and soft solids are dispensed, said closure assembly comprising: a hollow rigid bushing member mounted in the neck of the collapsible dispenser and extending along the length of the neck, a resilient sleeve having an elongated tubular-shaped external surface, and having a closed inner end of a width greater than the inner diameter of the neck, said sleeve being mounted coaxially within said bushing member with its external surface pressed against the inner surface of the bushing member in intimate contact therewith along the length of the bushing member to form an air-tight seal therewith, said sleeve and bushing member being retained within said neck solely by the engagement thereof with the neck and without any external supporting means whereby squeezing pressure applied to the dispenser causes the fluids and soft solids to be forced between the resilient sleeve member and the inner surface of the bushing to displace the resilient sleeve radially inwardly so as to permit the fluids and soft solids to pass through the resulting space between the outer surface of the sleeve and the inner surface of the bushing to be dispensed through the end of the neck.

3. The combination defined in claim 1, and which includes a cap member fitted over the neck of the dispenser and secured to the neck of the dispenser.

4. The combination defined in claim 1, in which said resilient sleeve is opened at its outer end.

5. The combination defined in claim 1, in which said resilient sleeve is closed at its outer end.

6. The combination defined in claim 2, in which said hollow rigid bushing member defines a channel through which the fluids and soft solids from the dispenser are dispensed.

7. The combination defined in claim 1, and which includes a clip closing the inner end of said resilient sleeve.

8. The combination defined in claim 1, in which said neck has an oval cross-section.

* * * * *